US006502375B2

(12) United States Patent
Resta

(10) Patent No.: US 6,502,375 B2
(45) Date of Patent: Jan. 7, 2003

(54) MACHINE FOR PACKAGING MATTRESSES IN A SHEET UNWOUND CONTINUOUSLY FROM A ROLL

(75) Inventor: Roberto Resta, Faenza (IT)

(73) Assignee: Resta S.r.l., Faenza (IT)

( * ) Notice: Subject to any disclaimer, the term of this patent is extended or adjusted under 35 U.S.C. 154(b) by 102 days.

(21) Appl. No.: 09/801,915

(22) Filed: Mar. 9, 2001

(65) Prior Publication Data

US 2001/0022061 A1 Sep. 20, 2001

(30) Foreign Application Priority Data

Mar. 14, 2000 (IT) ..... BO2000A134

(51) Int. Cl.[7] ..... B65B 11/12; B65B 43/08

(52) U.S. Cl. ..... 53/575; 53/228; 53/230; 53/389.4

(58) Field of Search ..... 53/228, 230, 389.2, 53/389.4, 574, 575

(56) References Cited

U.S. PATENT DOCUMENTS 3,125,841 A * 3/1964 Anderson ..... 53/228
4,351,142 A * 9/1982 Focke et al. ..... 53/389.4
5,193,328 A * 3/1993 Boriani et al. ..... 53/228
6,082,254 A * 7/2000 De Vlaam ..... 53/575

* cited by examiner

*Primary Examiner*—John Sipos
(74) *Attorney, Agent, or Firm*—Guido Modiano; Albert Josif; Daniel O'Byrne

(57) ABSTRACT

A machine for packaging a mattress in a sheet, comprising horizontal supporting and receiving mattress surfaces, guides for guiding the sheet on a vertical plane, so that by moving the mattress in the advancement direction from the supporting surface toward the receiving surface the sheet is arranged over and under the mattress, a device for joining and cutting the sheet upstream of the mattress and for forming a bag which wraps around the mattress, sheet unwinding assemblies comprising two rollers movable along the receiving surface with a return stroke, the rollers being articulated to rotate between alignment and parallel positions in which they are perpendicular or parallel to the advancement direction and to the sides of the mattress, and actuators for actuating the rollers.

7 Claims, 10 Drawing Sheets

MACHINE FOR PACKAGING MATTRESSES IN A SHEET UNWOUND CONTINUOUSLY FROM A ROLL

BACKGROUND OF THE INVENTION

The present invention relates to a machine for packaging mattresses in a sheet unwound continuously from a roll.

Mattress packaging machines are already known. A first type of these machines, shown in FIGS. 1, 2 and 3, comprises a frame provided with a horizontal surface 1 for supporting the mattress 2, at the end of which there is a tensioning roller 3 for guiding, at right angles to the surface 1, a packaging sheet 4 (usually made of plastics) unwound from a roll 4*a*. As the mattress 2 advances in the direction F, from the supporting surface 1 onto the package receiving surface 5, the sheet 4 (as shown in FIG. 2) is folded and stretched over and under the mattress 2, so as to form a bag which is then closed at the rear (see FIG. 3) and on both sides by heat-sealing.

Packaging defects often occur in these conventional packaging machines being due to the fact that the sheet unwound from the roll slides on the front edge of the mattress and therefore tends to form unsightly longitudinal creases and wrinkles owing to the unevenness and flexible consistency of the front edge.

In order to avoid these drawbacks, it has been proposed (FIGS. 4, 5 and 6) to push the mattress 2 against the sheet 4 by using a pusher 6 having an arm 7 which lies above the mattress, reaches beyond the front edge of said mattress and supports a roller 8 being parallel to the front edge of the mattress.

The roller 8 acts as a redirection element for the packaging sheet 4, preventing its contact with the front edge of the mattress and thus preventing the formation of creases.

The refinement of the roller supporting arm 7 in these packaging machines, however, entails a longer production cycle, since the arm 7 has to be fully returned above the supporting surface in order to clear the receiving surface for the descent of the heat-sealing bars that have to provide the heat-seal that closes the bag perimetrically.

SUMMARY OF THE INVENTION

The aim of the present invention is to provide a packaging machine which allows to avoid the formation of creases of the package without compromising the operating times.

This aim is achieved with a packaging machine whose characteristics are defined in the appended claims.

BRIEF DESCRIPTION OF THE DRAWINGS

Further characteristics and advantages of the present invention will become better apparent from the following detailed description of a preferred embodiment thereof illustrated only by way of non-limitative example in the accompanying drawings, wherein.

DESCRIPTION OF THE PREFERRED EMBODIMENTS

Figure 7:
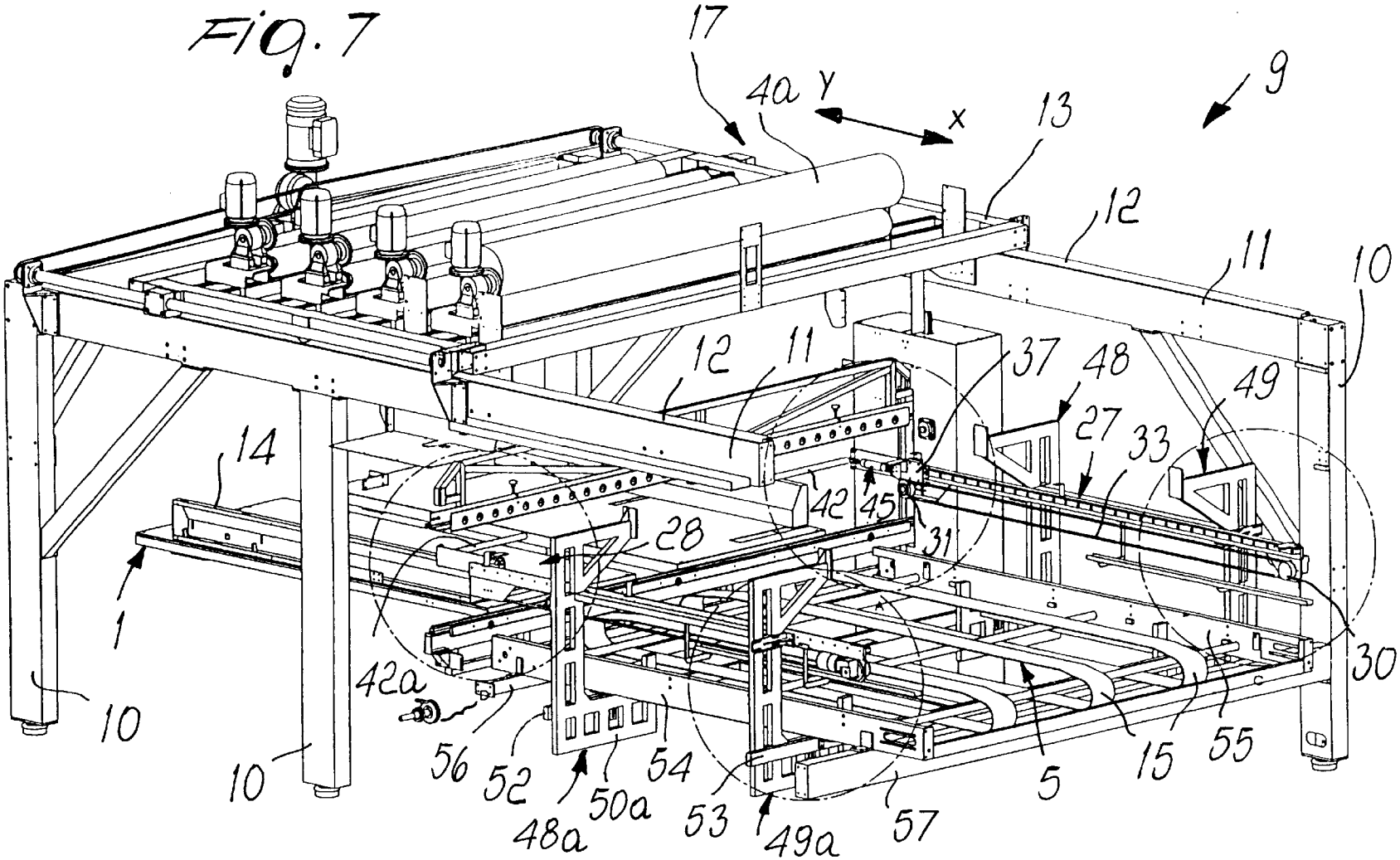
FIG. 7 is a perspective view of the apparatus.
Figure 8:
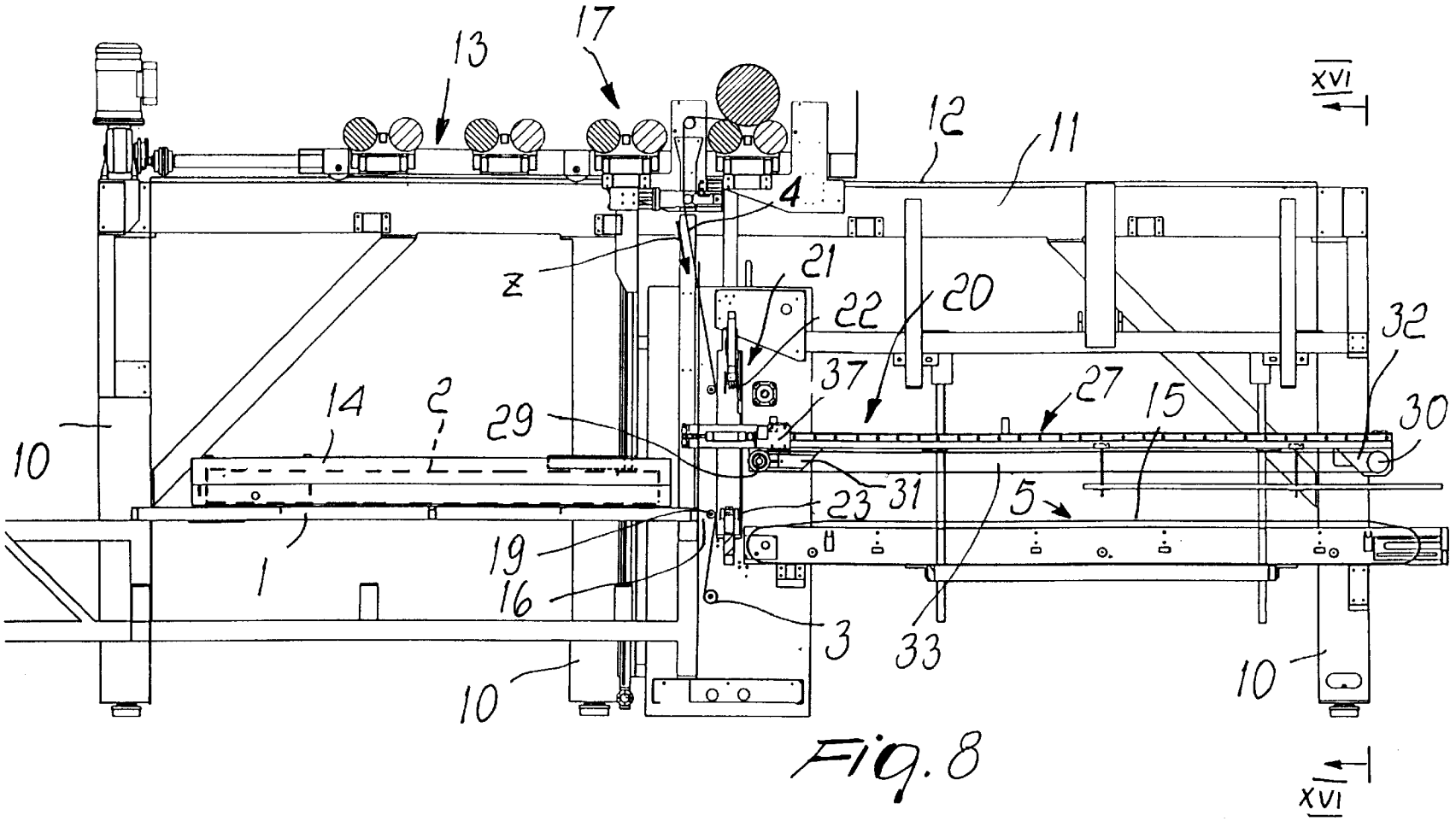
FIG. 8 is a sectional elevation view, taken along a longitudinal central plane.

With reference to FIGS. 7 and 8, the mattress packaging machine is generally designated by the reference numeral 9 and comprises a frame composed of vertical posts 10 which are mutually connected by longitudinal members and cross-members. In particular, the posts 10 are connected at the top by longitudinal members 11 which support two rails 12 for the sliding of a carriage 13 which is motorized so that it can move in both directions X and Y and on which the roll 4*a* that supplies the packaging sheet 4 is supported.

The frame comprises a supporting surface 1 with shoulders 14 for containing and guiding a mattress 2 and a receiving surface 5 being constituted by a plurality of belts 15. An opening 16 (FIG. 8) remains between the exit portion of the supporting surface 1 and the receiving surface 5, and the packaging sheet 4 is guided downward from above, through said opening, in the direction Z at right angles to the surfaces 1 and 5.

The mattress 2 to be packaged, by means of a pusher 6 (see FIG. 13) or the like, is pushed in the direction F against the sheet 4, which is stretched over and under the mattress 2 (see FIG. 14) by means of a pair of guiding rollers 18 and 19 and of a device 20 described hereinafter. When the mattress 2, after moving beyond the opening 16, reaches the receiving surface 5, the upper and lower flaps of the sheet 4, which lie upstream of the mattress, are joined by a heat-sealing assembly 21 composed of two heat-sealing bars 22 and 23 which provide two parallel heat-seals being spaced enough to allow a blade 24 which is intermediate thereto to cut and separate the sheet 4.

In this manner, the heat-sealing line downstream of the cut closes the sheet 4, forming a loop which wraps around the mattress 2, while the heat-sealing line upstream of the cut allows the sheet 4 to remain attached to the takeup roller 3 located below the surface 1, in order to allow to take up a portion which is long enough to prevent the heat-sealing line from remaining in the portion of sheet used to package the next mattress.

Figure 14:
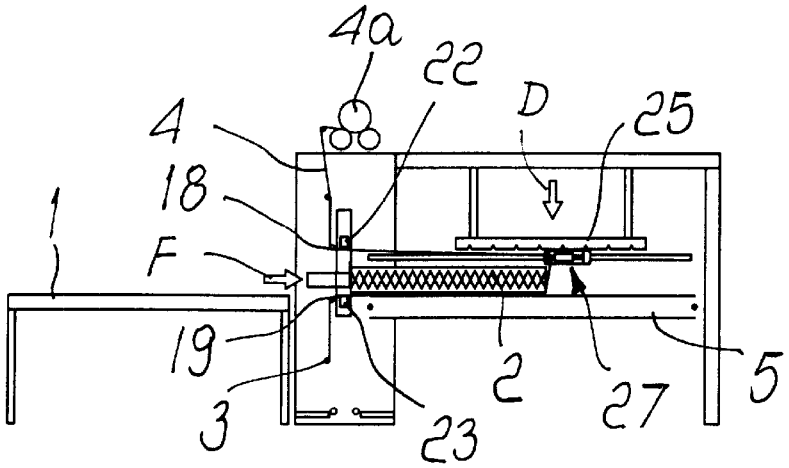
Figure 15:
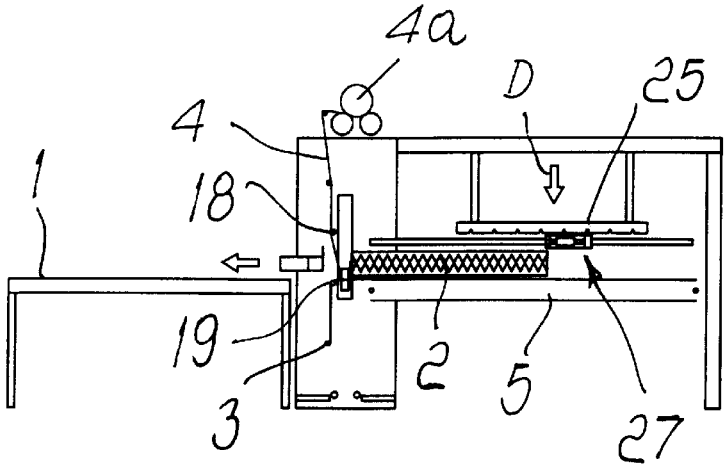

Once the mattress 2, with the sheet 4 wrapped in a loop around it, has advanced onto the conveyor 15, two lateral heat-sealing units 25 (FIGS. 13–15), actuated in the direction D, close it laterally so as to form a hermetic bag.

Figure 1:
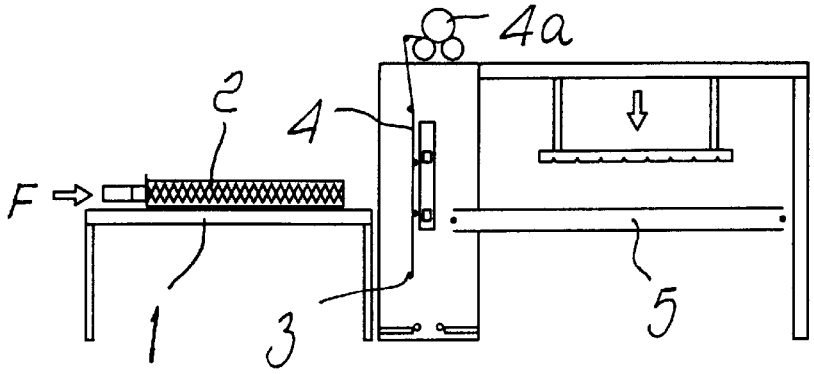
Fig. 1 PRIOR ART
FIGS. 1–6 show known type of mattress packaging machines.
Figure 2:
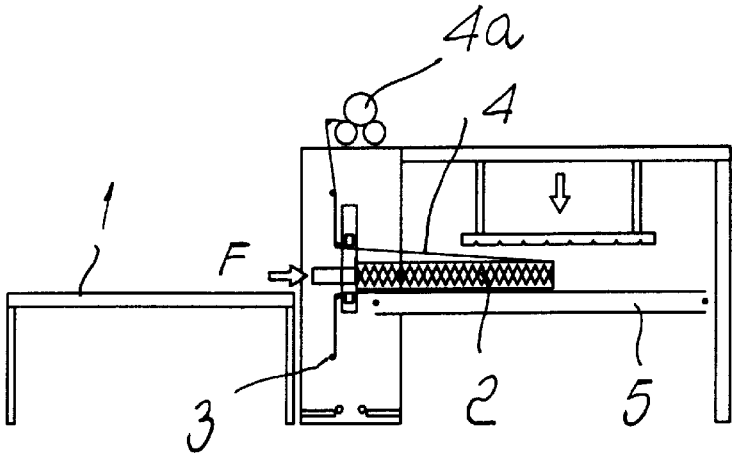
Fig. 2 PRIOR ART
Figure 3:
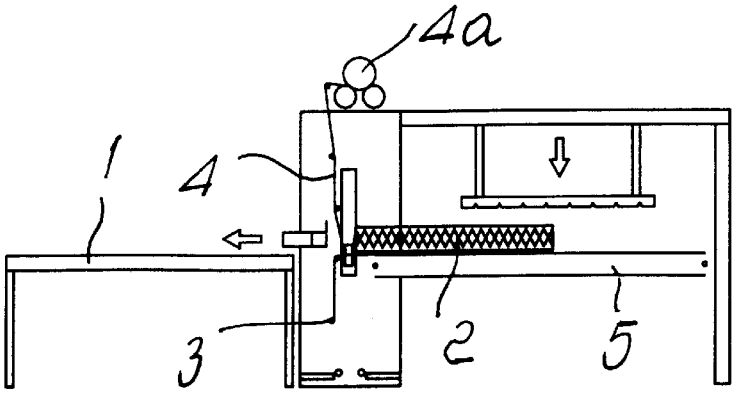
Fig. 3 PRIOR ART
Figure 4:
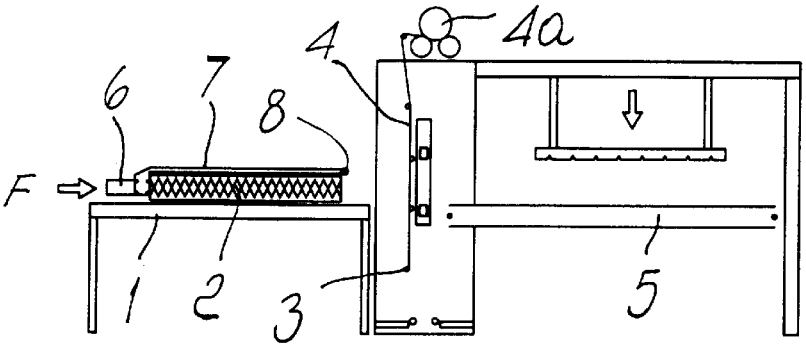
Fig. 4 PRIOR ART
Figure 5:
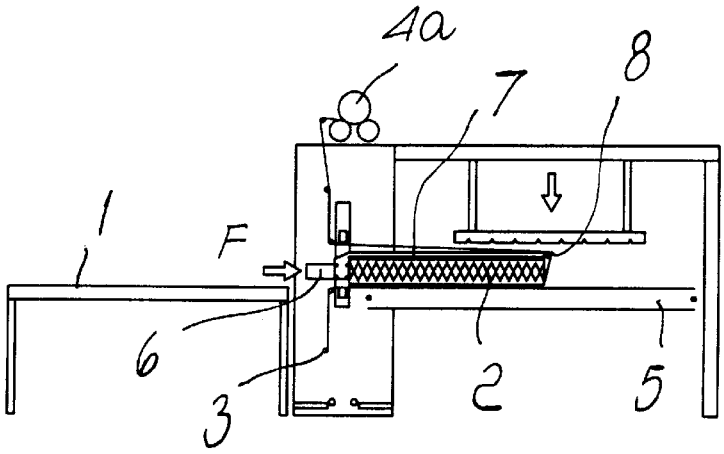
Fig. 5 PRIOR ART
Figure 6:
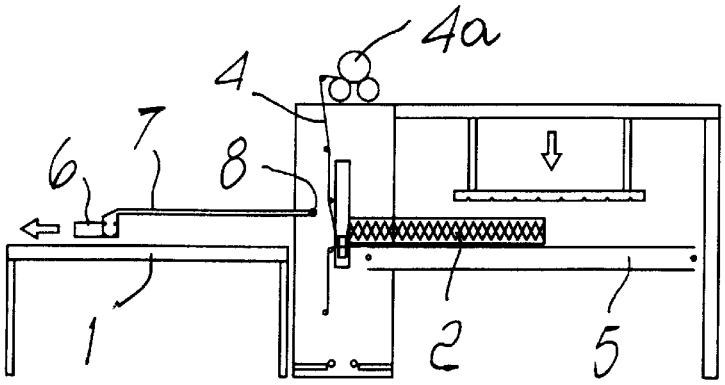
Fig. 6 PRIOR ART

The machine shown in FIGS. 1 and 2 is equipped with an apparatus for automatically changing the roll 4*a* from which the sheet is taken either because it is about to end or because it is necessary to change the type of sheet used to package the mattresses. Said apparatus (generally designated by the reference numeral 17) is not described hereinafter for the sake of brevity in description and because it is beyond the scope of the present invention. However, it is disclosed in U.S. Ser. No. 09/677,763 of Oct. 3, 2000 by the same Applicant and reference is made thereto as an integral part of the present description.

The device 20 that completes the arrangement of the sheet 4 over and under the mattress 2 is composed of two unwinding assemblies 27 and 28 which are adapted to engage the sheet 4 and gradually pull it in the direction F in front of the mattress, as said mattress is moved forward, by means of the pusher 6, from the surface 1 onto the surface 5.

Figure 9:
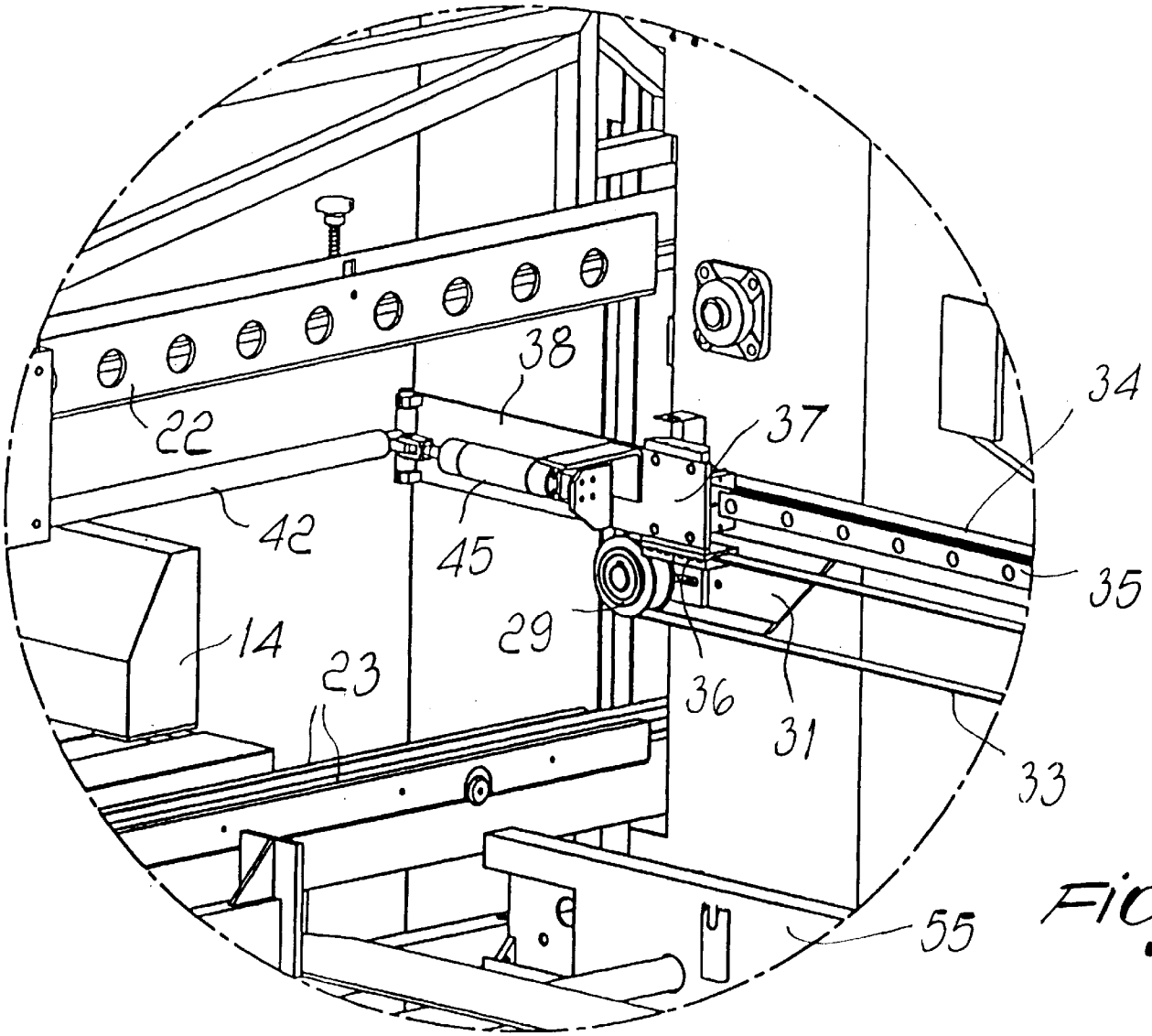
FIGS. 9 and 10 are views of two details enclosed in the circles A and B of FIG. 7.
Figure 10:
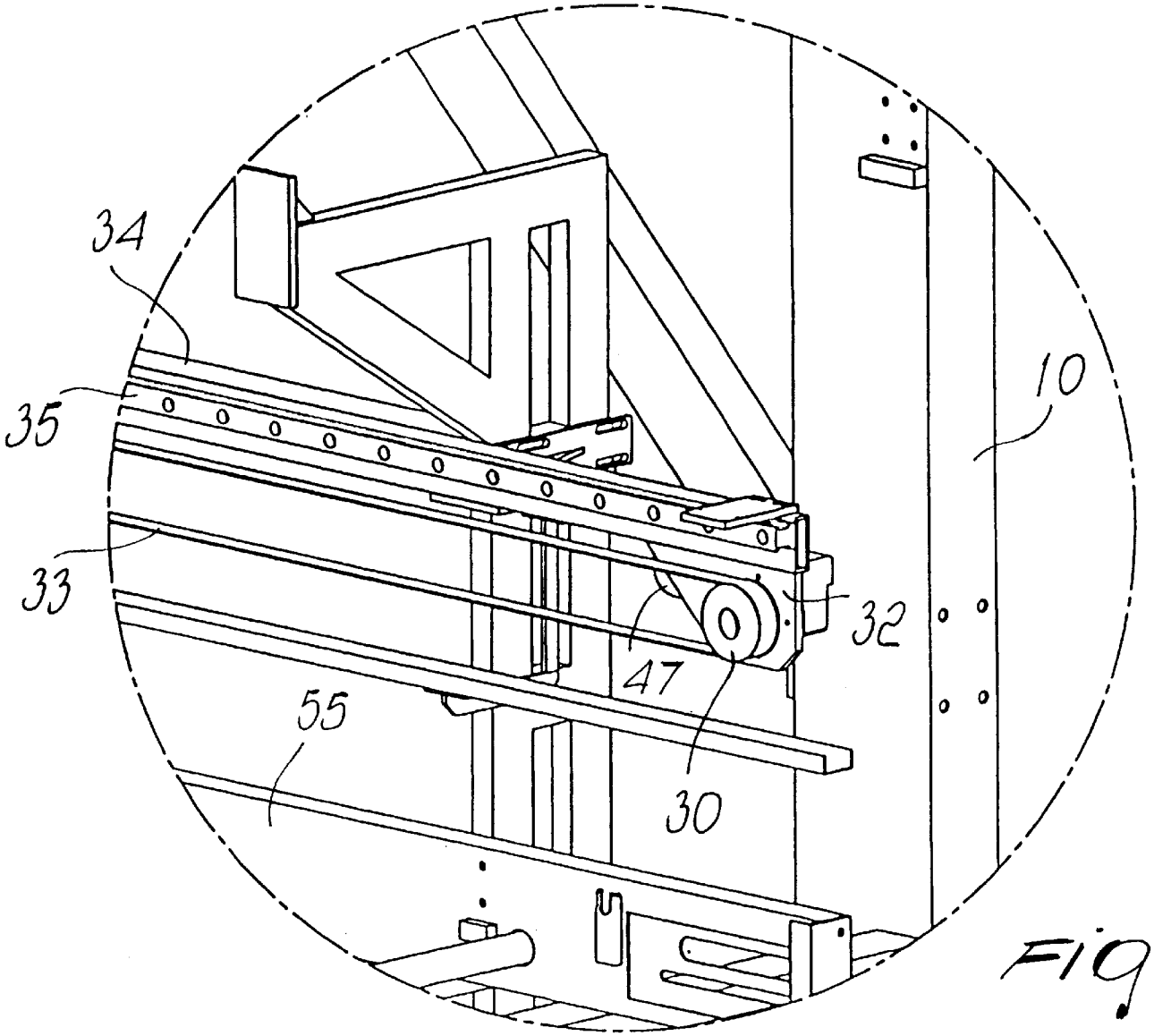
Figure 11:
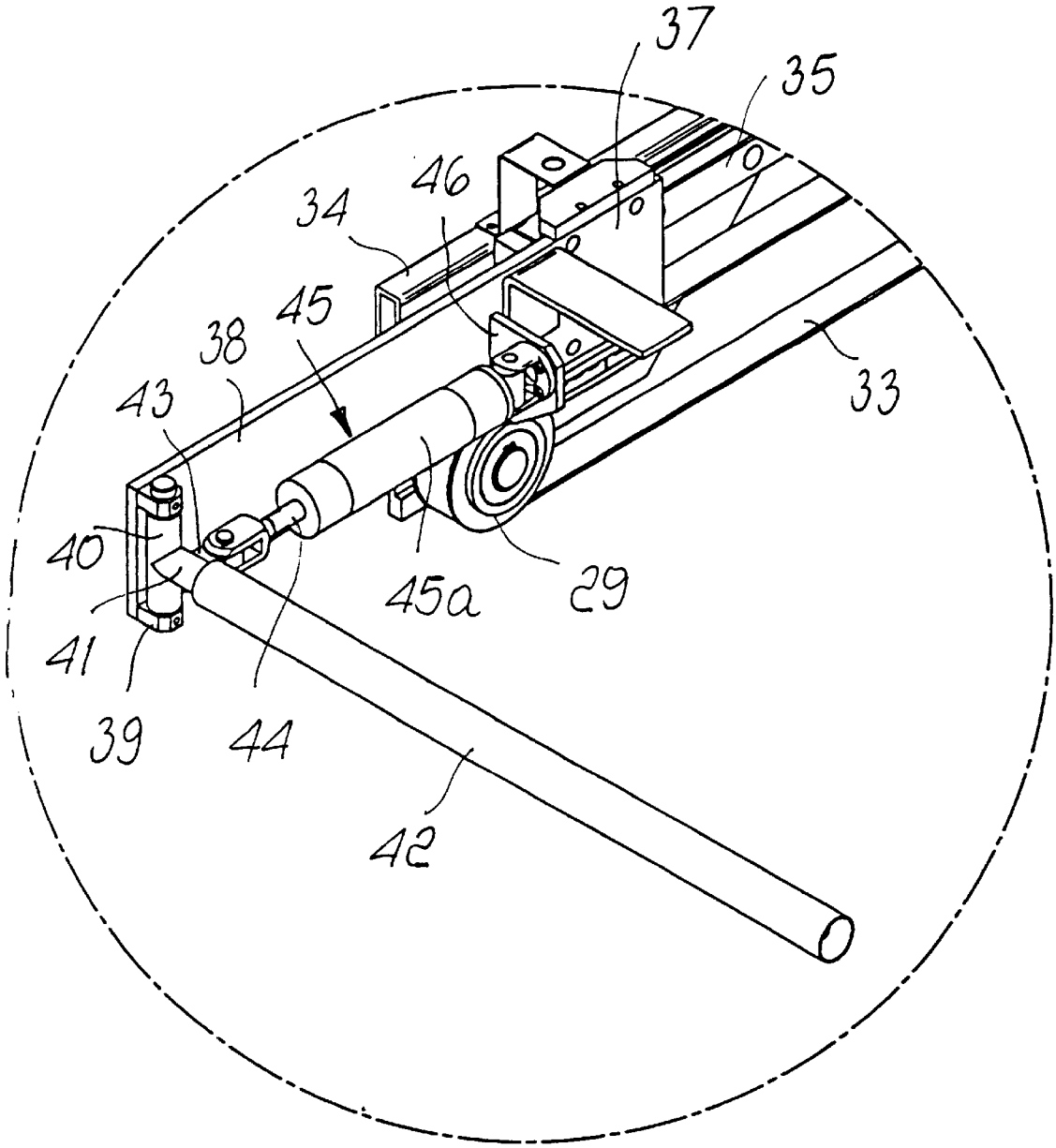
FIG. 11 is a view of the detail FIG. 9, taken from another viewpoint.

The assembly 27 (visible as a whole in FIG. 12) is composed (see particularly FIGS. 9–11) of a pair of pulleys 29 and 30 which cantilever out above the surface 5 from respective flanges 31, 32 on which they are rotatably supported.

A belt 33 is closed in a loop on the pulleys 29, 30 and its upper and lower portions are horizontal.

Figure 16:
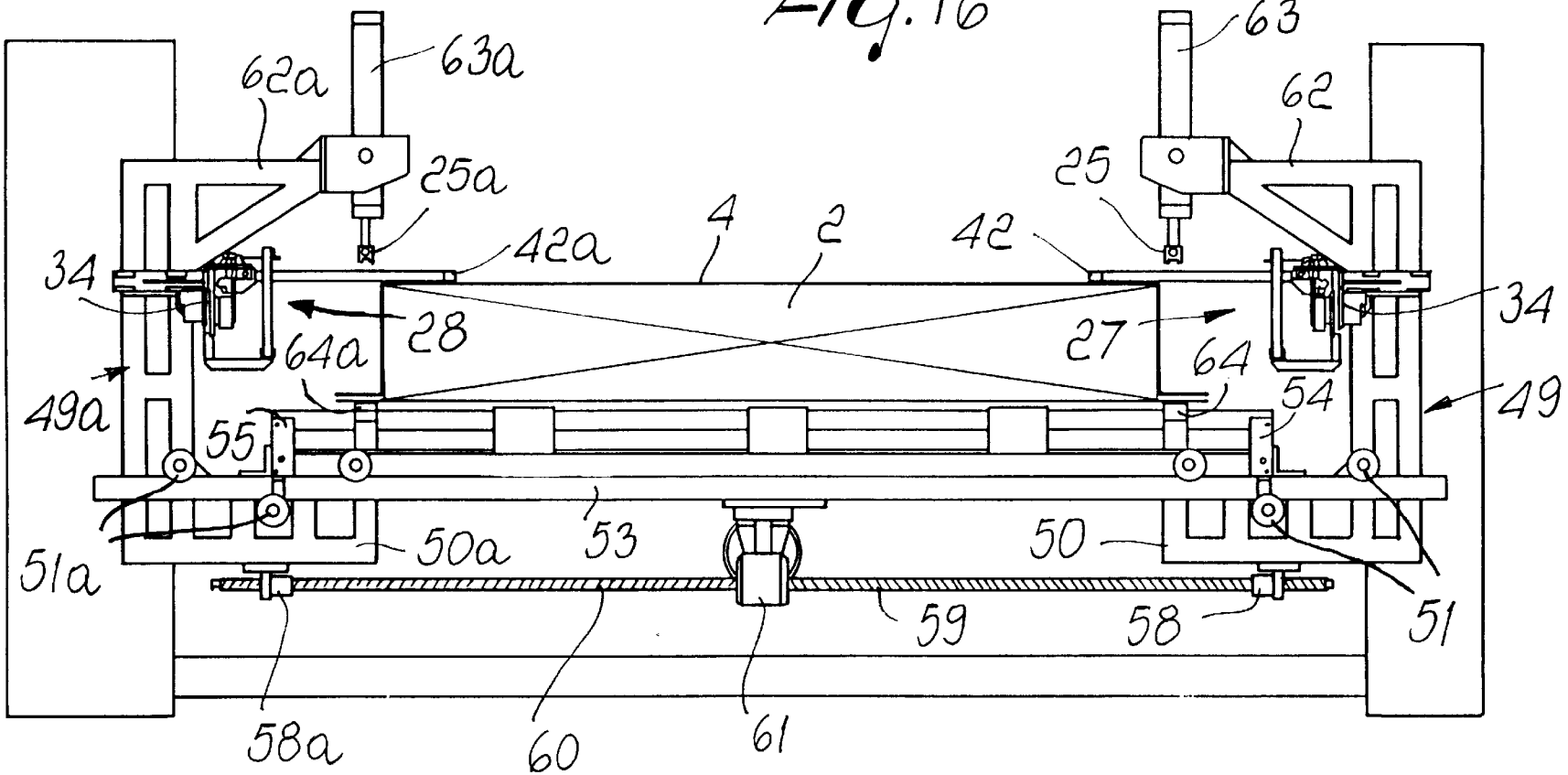
FIG. 16 is a view of the machine, taken in the direction XVI—XVI of FIG. 8.

The flanges 31, 32 are rigidly coupled to a side wall 34 which lies to one side of the conveyor 15 and is supported so as to be rigidly coupled to the posts 10, so that it can be moved parallel to itself, as will become better apparent from the description of FIG. 16 that follows.

A guide 35 is fixed to the inner face of the side wall 34 and is parallel to the upper portion of the belt 33. A slider 37 is coupled to the upper portion of the belt 33 by means of a clamp 36 (see FIG. 9), and a bracket 38 protrudes from said slider toward the surface 1 and is flat and parallel with respect to the side wall 34.

Two mutually superimposed lugs 39 (see FIG. 11) are fixed to the end of the bracket 38, and a stem 40 is supported in said lugs so that it can rotate about a vertical axis; a bar 41 protrudes at right angles from said stem 40. A roller 42 can rotate on the bar 41 and protrudes toward the centerline of the pivot 5. The roller 42 lies at a level, with respect to the surface 5, such that its rotation plane about the vertical axis is higher than the height of the mattress to be packaged, so that it cannot interfere with said mattress by rotating.

A tab 43 is rigidly coupled to the bar 41, proximate to the stem 40, and the stem 44 of a fluid-actuated jack 45 is articulately coupled in said tab 43; the cylinder 45*a* of said jack is articulated to an L-shaped element 46 being fixed to the bracket 38.

The actuation of the jack 45 actuates the oscillation, on a horizontal plane, of the roller 42 between a position which is perpendicular to the bracket 38 and a position in which the roller 42 is arranged itself as an extension of the bracket 38.

Of the two pulleys 29 and 30, the pulley 29 is the driven one and the pulley 30 is the driving one. In order to actuate the pulley 30 there is a motor 47 which is mounted outside the flange 32. The motor 47 is of the reversible type, so that the slider 37, and therefore the roller 42, is given a back-and-forth movement along the guide 35. This movement of the roller

42 in the mattress advancement direction F is synchronized with the movement of the pusher 6.

Figure 12:
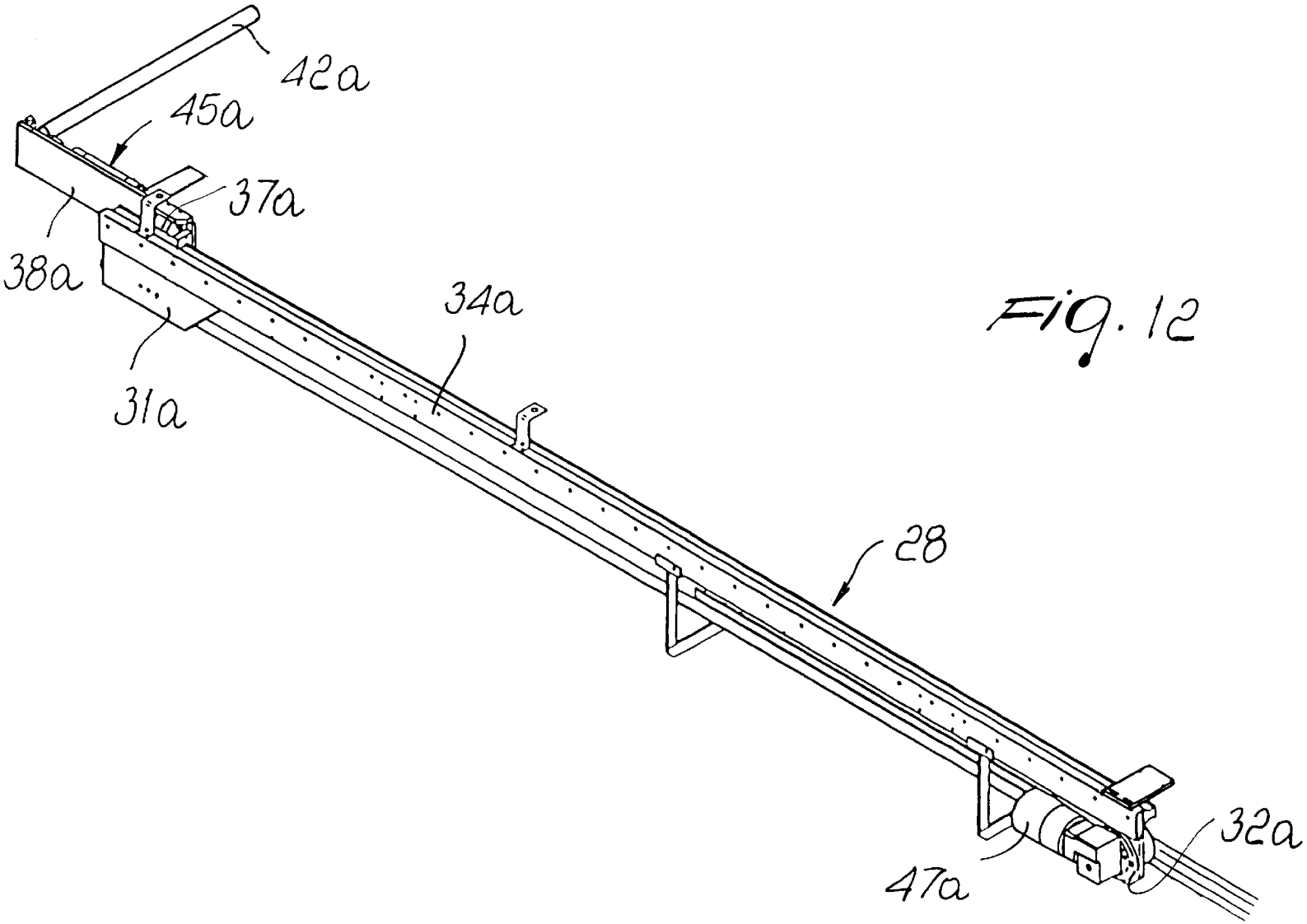
FIG. 12 is a perspective view of an element of the machine.

The other sheet transport assembly 28 is mirror-symmetrically similar to the above-described assembly 27 and is shown in perspective in FIG. 12, where its parts are designated by the same reference numerals with the addition of the letter "a".

The operation of the described machine is as follows.

Figure 13:
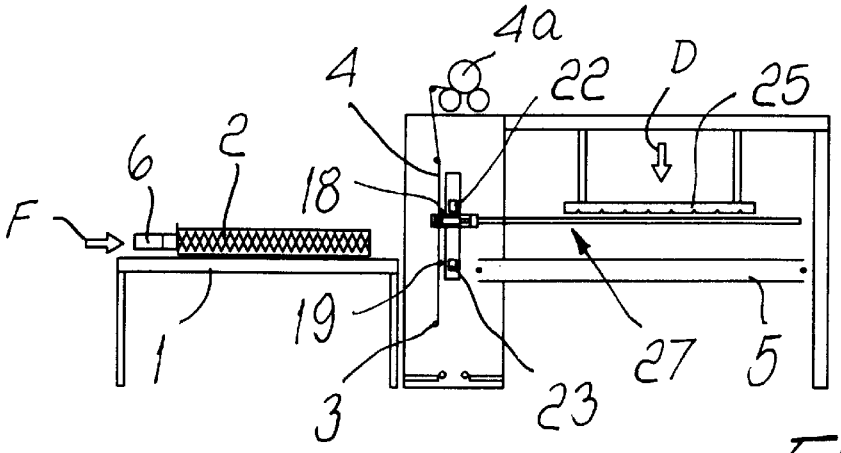
FIGS. 13, 14 and 15 are views of three successive operating conditions of the machine; and finally

Assume an initial condition of FIG. 13, in which the sliders 37 and 37*a* of the two unwinding assemblies 27 and 28 are arranged proximate to the heat-sealing assembly 21 with the rollers 42, 42*a* mutually aligned, i.e., at right angles to the direction F in which the mattress 2 advances and upstream of the sheet 4, which is stretched at right angles downstream of them between the roll 4*a* and the tensioning roller 3.

In this situation, when the front end of the mattress 2 is about to strike the sheet 4, the sliders 37, 37*a* are actuated in the direction F, so that the rollers 42, 42*a* stretch the sheet 4 in front of the mattress. As the rollers 42, 42*a* advance, the sheet 4, unwound from the roll 4*a* and guided by the roller 18, is stretched under the mattress.

Once the rear end of the mattress 2 has passed beyond the heat-sealing assembly 21 and therefore the mattress 2 is resting fully on the receiving surface 5, the jacks 45, 45*a* are activated and, by turning the rollers 42, 42*a* from the mutual alignment position to the parallel position, determine their disengagement from the sheet 4.

Once the rollers 42, 42*a* are arranged parallel to the direction F at the sides of the mattress, the pusher 6 is retracted and the flaps of the sheet 4 that lie to the rear of the mattress are heat-sealed by means of the heat-sealing bars 22 and 23 and the lateral flaps are heat-sealed by means of the heat-sealing bars 25, so as to provide perimetric closure of the package.

After removing the mattress 2 from the surface 5, the sliders 37, 37*a* are returned to the initial position proximate to the heat-sealing assembly 21; once said assembly has been reached, the jacks 45, 45*a* are activated so as to turn the rollers 42, 42*a* into the alignment position behind the sheet 4. The cycle can thus be repeated in the above-described manner.

The fundamental feature of the present invention is that the rollers 42, 42*a* are made to advance in front of the front end of the mattress, so as to prevent the onset of undue traction stresses on the sheet 4, which in conventional machines are caused by the friction with which the sheet adheres to the mattress.

The coaxial arrangement of the rollers 42, 42*a* in the alignment position further defines a cylindrical surface which keeps the sheet 4 perfectly stretched transversely and prevents creasing.

It is evident that the device 20 fully achieves the intended aim and objects. In particular, it should be noted that the heat-sealing and cutting of the sheet 4 to the rear of the mattress 2 can occur directly after the rollers 42, 42*a* have been turned on a horizontal plane to the side of the mattress, i.e., as soon as they are in a position in which they are disengaged from the sheet.

After the disengagement of the rollers 42, 42*a*, the mattress 2 can advance in order to allow the lateral heat-sealing units 25, 25*a* to provide the lateral heat-seals which, by intersecting the rear heat-seal, allow to close the package hermetically. It should be noted that the execution of the lateral heat-seals does not hinder the return of the rollers 42, 42*a* into the engagement position upstream of the sheet 4.

Another particularity of the described machine is that the unwinding assemblies 27, 28 and the lateral heat-sealing units 25, 25*a* can be moved at right angles to the direction F in order to be adapted to the lateral dimensions of the mattress.

For this purpose (see FIGS. 7, 16), on one side of the receiving surface 5 there is a pair of C-shaped shoulders 48, 49. Likewise, on the other side of the mattress there is a second pair of shoulders 48*a*, 49*a* being mirror-symmetrical with respect to the shoulders 48 and 49 in terms of shape and arrangement. The lower arms 50, 50*a* of the shoulders 48, 48*a* and 49, 49*a* have rollers 51, 51*a* which slide on two rails 52, 53 which lie transversely to the direction F and are rigidly coupled to respective longitudinal beams 54, 55 being fixed on cross-members 56, 57 which connect the posts 10 one another. Accordingly, the shoulders 48, 49 and 48*a*, 49*a* constitute two carriages which can slide on the rails 52, 53.

Two female threads 58, 58*a* are fixed under the lower arms 50, 50*a* of the two mutually opposite shoulders 49,

49*a*, and two rods 59, 60 with mutually opposite threads are engaged in said female threads by screw coupling and are actuated by a gearmotor 61 which is mounted under the rail 53. The gearmotor 61 also actuates, by means of an appropriate transmission which is not shown but entirely conventional, the two shoulders 48, 48*a*, so that the shoulders 48, 49 move in opposition to the shoulders 48*a*, 49*a*.

The side walls 34, 34*a* of the two unwinding assemblies 27 and 28 are rigidly coupled to the shoulders 48, 49 and 48*a*, 49*a* and accordingly follow the transverse mutual approach and spacing movements of the shoulders actuated by the gearmotor 61.

The shoulders 48, 49, 48*a*, 49*a* have, at their top, two upper arms 62, 62*a* which support respective vertical jacks 63, 63*a*, to the stems of which the heat-sealing bars 25, 25*a* are fixed. The heat-sealing bars 25, 25*a* cooperate with abutment bars 64, 64*a* which are mounted on the lower arms 50, 50*a* at the level of the receiving surface 5.

From the above description it is evident that by actuating the gearmotor 61 it is possible to arrange the heat-sealing bars 25, 25*a* and the corresponding abutment bars 64, 64*a* at the distance that allows heat-sealing of the lateral flaps of the sheet 4, after the rollers 42, 42*a* have been turned into the position in which they are parallel to the sides of the mattress. In this position, the rollers 42, 42*a* are in any case outside the descent planes of the heat-sealing bars, so that they can perform their return stroke toward the sheet during the provision of the lateral heat-seals.

The disclosures in Italian Patent Application No. BO2000A000134 from which this application claims priority are incorporated herein by reference.

What is claimed is:

1. A machine for packaging a mattress in a sheet which is unwound continuously from a feeder roll, the machine comprising: a horizontal supporting surface for said mattress; a horizontal receiving surface; guiding means for guiding said sheet in a substantially vertical direction which passes between said supporting surface and said receiving surface, so that by moving said mattress in an advancement direction from said supporting surface toward said receiving surface said sheet is arranged over and under said mattress; joining and cutting means for joining and cutting said sheet, upstream of said mattress, along said advancement direction, and for forming a bag which wraps around said mattress in a loop; unwinding assemblies for unwinding said sheet from said feeder roll, which comprise two rollers movable along said receiving surface, said rollers being actuatable with an outgoing stroke, in said advancement direction, and with a return stroke, said rollers being articulated about vertical, axes to rotate between an alignment position, in which the rollers are perpendicular to the advancement direction and a position in which the rollers are parallel to said advancement direction and to the sides of said mattress; and actuation means for actuating said rollers to reach said alignment position, upstream of said sheet while said mattress is arranged on the supporting surface and to maintain said position during said outgoing stroke and transfer of the mattress from the supporting surface onto the receiving surface, in order to allow said rollers to engage and stretch said sheet over and under the mattress, and to return to said position in which they are parallel to the advancement direction after the mattress has been transferred onto said receiving surface, in order to allow said rollers to disengage from said sheet and return to said position for engaging said sheet.

2. The machine of claim 1, wherein said unwinding assemblies comprise: two guides which are arranged at sides of said receiving surface and are parallel to said advancement direction; respective sliders each of which is slideable on a respective one of said guides; respective horizontal rollers each of which being articulated along a respective vertical axis to a respective one of said sliders; and respective jacks for actuation of said rollers between said alignment and parallel positions, said jacks being each supported on a respective one of said sliders.

3. The machine of claim 2, comprising: a driving pulley; a driven pulley; a reversible motor and a horizontal portion of a belt which is closed in a loop on said driving and driven pulleys, said driving pulley being actuated by said motor in order to make said sliders, which are fixed on said belt, perform said outgoing and return strokes.

4. The machine of claim 3, wherein said rollers are rotatable about respective vertical axes thereof on horizontal planes, which lie above the upper face of the mattresses.

5. The machine of claim 1, in combination with an apparatus for automatic roll changing.

6. The machine of claim 2, further comprising sealing elements for lateral heat-sealing of said bag, said unwinding assemblies and said sealing elements being adjustable transversely to the advancement direction of the mattress.

7. The machine of claim 6, comprising: rails arranged transversely to said advancement direction, carriages which are slideable on said rails, said unwinding assemblies and said sealing elements being mounted on said carriages; and adjusting means for adjusting a position of said unwinding assemblies and of said sealing elements on said rails.

* * * * *